US009567044B2

(12) United States Patent
Vandenworm

(10) Patent No.: US 9,567,044 B2
(45) Date of Patent: Feb. 14, 2017

(54) SEMISUBMERSIBLE WITH TUNNEL STRUCTURE

(71) Applicant: SSP TECHNOLOGIES, INC., Grand Cayman (KY)

(72) Inventor: Nicolaas Johannes Vandenworm, Houston, TX (US)

(73) Assignee: JURONG SHIPYARD PTE. LTD., Singapore (SG)

( * ) Notice: Subject to any disclaimer, the term of this patent is extended or adjusted under 35 U.S.C. 154(b) by 162 days.

(21) Appl. No.: 14/543,524

(22) Filed: Nov. 17, 2014

(65) Prior Publication Data

US 2015/0166149 A1 Jun. 18, 2015

Related U.S. Application Data

(60) Provisional application No. 61/915,585, filed on Dec. 13, 2013.

(51) Int. Cl.

| | |
|---|---|
| ***B63B 35/44*** | (2006.01) |
| ***B63B 1/10*** | (2006.01) |
| ***B63B 21/00*** | (2006.01) |
| ***B63B 27/30*** | (2006.01) |

(52) U.S. Cl.
CPC ..... *B63B 35/44* (2013.01); *B63B 1/107* (2013.01); *B63B 21/00* (2013.01); *B63B 27/30* (2013.01); *B63B 2021/001* (2013.01)

(58) Field of Classification Search
CPC ..... B63B 35/44; B63B 35/4413; B63B 2035/4426;B63B 2035/4473; B63B 2035/448; B63B 2035/4486; B63B 9/065; B63B 27/36; B63B 27/30
See application file for complete search history.

(56) References Cited

U.S. PATENT DOCUMENTS

| | | | | |
|---|---|---|---|---|
| 1,334,445 | A | 3/1920 | Gaffney | |
| 2,156,635 | A | 5/1939 | Mascuch et al. | |
| 3,041,639 | A | 7/1962 | Atlas | |
| 4,281,615 | A * | 8/1981 | Wilson | A62C 3/10 114/265 |
| 4,282,822 | A | 8/1981 | Jackson | |
| 4,446,808 | A | 5/1984 | Colin | |
| 4,549,835 | A | 10/1985 | Ando et al. | |
| 4,640,214 | A | 2/1987 | Bruns | |
| 4,679,517 | A | 7/1987 | Kramer | |
| 4,984,935 | A | 1/1991 | de Oliveira Filho et al. | |
| 5,573,353 | A | 11/1996 | Recalde | |
| 6,524,050 | B1 | 2/2003 | Arntzen et al. | |

(Continued)

*Primary Examiner* — Andrew Polay
(74) *Attorney, Agent, or Firm* — Buskop Law Group, PC; Wendy Buskop

(57) ABSTRACT

A semisubmersible with a plurality of surface piercing columns, a plurality of pontoons attached to and extending between pairs of adjacent surface piercing columns, a tunnel side formed between a first pair of surface piercing columns, an additional tunnel side formed between a second pair of surface piercing columns, a tunnel floor formed between the tunnel sides. A tunnel opening formed between the tunnel sides for receiving a floating vessel into the tunnel structure, and a main deck secured to the plurality of surface piercing columns. The semisubmersible can be ballasted to an operational depth and deballested to a transit depth.

22 Claims, 9 Drawing Sheets

(56) References Cited

U.S. PATENT DOCUMENTS

| | | | | |
|---|---|---|---|---|
| 7,117,810 | B2 * | 10/2006 | Kristensen | B63B 35/4413 114/265 |
| 7,216,603 | B2 * | 5/2007 | Towley, III | B63C 13/00 114/263 |
| 7,958,835 | B2 | 6/2011 | Srinivasan | |
| 8,251,003 | B2 | 8/2012 | Vandenworm | |
| 8,662,000 | B2 | 3/2014 | Vandenworm | |
| 2003/0106173 | A1 * | 6/2003 | Miller | B63B 27/14 14/71.1 |
| 2007/0051294 | A1 | 3/2007 | Pike | |
| 2012/0132122 | A1 * | 5/2012 | Vandenworm | B63B 1/041 114/261 |
| 2012/0192782 | A1 | 8/2012 | Eide | |
| 2013/0133563 | A1 | 5/2013 | Kroecker | |

* cited by examiner

SEMISUBMERSIBLE WITH TUNNEL STRUCTURE

CROSS REFERENCE TO RELATED APPLICATION

The current application claims priority to and the benefit of U.S. Provisional Patent Application Ser. No. 61/915,585 filed on Dec. 13, 2013, entitled "SEMISUBMERSIBLE WITH TUNNEL". This reference is incorporated in its entirety.

FIELD

The present embodiments generally relate to a semisubmersible with a tunnel structure used for supporting offshore oil and gas operations.

BACKGROUND

A need exists for a semisubmersible with a tunnel structure formed between surface piercing columns of the semisubmersible.

A further need exists for a semisubmersible with a tunnel structure that provides wave damping and wave breakup, swell and current protection within the tunnel structure.

A need exists for a semisubmersible that provides a safe and sheltering environment of a floating vessel in the tunnel structure.

The present embodiments meet these needs.

BRIEF DESCRIPTION OF THE DRAWINGS

The detailed description will be better understood in conjunction with the accompanying drawings as follows.

Figure 1A:
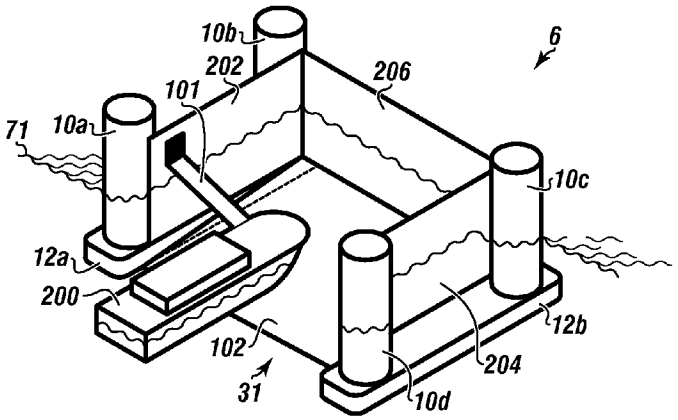
FIG. 1A is a perspective view of an embodiment of the semisubmersible without a door.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a semisubmersible with a tunnel structure used for supporting offshore oil and gas operations.

The embodiments further relate to a semisubmersible with a tunnel structure that allows for safe transport of personnel from a semisubmersible in the event of an approaching hurricane.

The following terms are used herein.

The term "branch" refers to a passageway from the tunnel structure which is at an angle that varies from 1 degrees to 180 degrees from a longitudinal axis of the tunnel structure. The branch can communicate between the tunnel structure and another opening in the semisubmersible. The branch can be configured to contain at least one floating vessel in the branch. The branch can serve as a passageway that allows a floating vessel to exit the tunnel structure without having to rotate within the tunnel structure.

The term "floating vessel" refers to a workboat, a hovercraft, a supply boat, a passenger/crew boat, a barge, a submarine, a trimarine, a catamarine, a hydrofoil, or a vessel known in the industry that is applicable.

The term "gangways" refers to mechanisms installed in the tunnel structure for quick evacuation of the semisubmersible to the floating vessel by allowing degrees over the mechanisms by people and supplies. The gangways can be installed above or outside the tunnel. In embodiments, the gangways can be configured for pivoting and locking out of the way of a floating vessel entering the tunnel structure, and the plurality of gangways can be configured to unlock and pivot to engage the floating vessel.

The term "lifting mechanism" refers to a combination of a movable cradle on a support, the movable cradle can be connected to a hoist positioned on the main deck, on a structure above the main deck, or on the side of the tunnel structure and below the main deck for lifting the movable cradle sufficiently to take the full load of the floating vessel. In embodiments, the movable cradle can be a plurality of lifting straps or a lifting frame.

The term "main deck" refers to the generally horizontal structure supported by the plurality of surface piercing columns onto which a superstructure, crew quarters, a heliport, or combinations thereof is formed. The main deck can extend over all or part of the hull.

The term "movement of water" refers to wave action, such as sloshing, current, and harmonic wave patterns.

The phrase "open and close" is used when referring to a door covering a second opening in the tunnel structure that can be opened and closed. In embodiments, the second opening can have a movable door that can pivot open and pivot close over the second opening allowing the floating vessel to exit the tunnel structure without turning around. In embodiments, the second opening can have a movable door that can slide horizontally on rails to "open and close" over the second opening. In still other embodiments, the movable door can be configured to slide upwardly and downwardly on rails to "open and close" sequentially, the second opening can allow the floating vessel to exit the tunnel structure through the second opening in the same direction that the floating vessel entered the tunnel structure, without turning around.

The term "operational depth" refers to a ballasted depth of the semisubmersible. The operational depth can be a draft that varies from 4 meters to 100 meters. The semisubmersible can be adapted to initiate ballast protocol to transit to operation draft by the use of electric centrifugal ballast pumps and by use of gravity based ballast (water) to direct the outer sea water through sea chest intakes within the semisubmersible ballast piping configuration.

The term "pivot anchor" refers to an attaching mechanism that allows one of the rotatable arms to pivot about an axis of a connecting pin which engages a bushing.

The term "pontoons" refers to a hollow metal container with a keel, positioned opposite the surface piercing columns and connected to at least one surface piercing column that can allow temporary or permanent storage of ballast water or other products. Pontoons can contain ballast tanks that can be simultaneously ballasted and deballasted or sequentially ballasted and deballasted. The pontoon can be rectangular, square, round, ellipsoidal, hexagonal or another polygonal shape.

The term "ramp" as used herein refers to a sloping surface that extends from underwater to above the water, much like a beach. The ramp is specifically created within the tunnel structure allowing a floating vessel to be "self beaching" within the tunnel. In embodiments, the ramp engages the movable cradle, mounted on wheels or to a railway mounted to the ramp. The movable cradle can be used for pulling the floating vessel at least partially out of the water while within the tunnel structure.

The term "rotatable arms" refers to arms that can rotate from 0 degrees to 180 degrees. The rotatable arms can provide a positive resistance to the floating vessel.

The rotatable arms can be either flush against the sides of the tunnel structure or rotate out to be 90 degrees, or perpendicular to a side of the tunnel structure. In particular, the rotatable arms can be mounted to have at least one arm on a tunnel structure with two opposing side walls.

The term "safe haven" refers to a protected environment, that allows people and supplies to safely transit from the floating vessel to the semisubmersible, such as by gangways. This embodiment allows a large number of personnel and supplies, such as from 10 people to 700 people to safely evacuate from the semisubmersible to the floating vessel quickly, such as in 40 minutes or less. The embodiments provide an efficient evacuation of the semisubmersible in the event of a Tsumami or hurricane. In embodiments, a plurality of gangways can be installed in the tunnel structure such as on pivot mechanism, which allows the gangway to rotate quickly to the floating vessel after it enters the tunnel structure.

The term "stepped shape" refers to a shape of the columns which imitates at least one sequence of two stairs.

The term "surface piercing columns" refers to a column that connects a pontoon with a structure above the pontoon, such as a middeck or a main deck above and through the water column. Surface piercing columns can have shapes that are square, rectangular, cylinder, or ellipsoidal.

The term "tunnel opening" refers to a tunnel opening configured to allow a floating vessel at the operational depth to enter the tunnel structure. In embodiments, the tunnel opening can provide an enclosure which a floating vessel can enter with doors that close behind the floating vessel, providing a complete enclosure of the floating vessel in the tunnel structure.

The term "tunnel structure" refers to a garage like structure. In embodiments, the tunnel structure can have a first side, a second side and a top connected between the first and second sides allowing a floating vessel to float, either under power, pushed or pulled into the tunnel structure creating a safe haven for the floating vessel while at sea. In embodiments, the tunnel structure can protect a small boat from being tossed, and damaged in a force 1 to force 2 hurricane. In embodiments, the tunnel structure can have a partially enclosed top within the semisubmersible structure.

In embodiments, the semisubmersible can be anchored or can be positioned using dynamic positioning.

Turning now to the Figures, FIGS. 1A-1D depict multiple embodiments of a semisubmersible 6 capable of ballasting and deballasting between a transit depth and an operational depth 71.

The semisubmersible 6 can have a plurality of surface piercing columns 10*a*-10*d*. The surface piercing columns can contain access to the ballast tanks that are located in the submersible pontoons and the surface piercing columns or in the column itself.

The plurality of surface piercing columns can have a flared outwards and upwards shape, a stepped shape, or a flared inwards and upwards shape. In embodiments, the surface piercing columns can be a combination of these shapes, one surface piercing column can be flared outwards and upwards, the next surface piercing column can be a stepped shape, and a third surface piercing column can be a flared inwards and upwards shape. All shaped surface piercing columns can be secured to a first pontoon. A second pontoon can support a similar combination of shapes in creating the semisubmersible.

The surface piercing columns can have a diameter from 10 meters to 200 meters and a height from 10 meters to 190 meters.

The plurality of surface piercing columns can each have a shape which is at least one of: a square shape, a rectangular shape, a cylindrical shape, a polygonal shape and a generally conical shape. All the surface piercing columns of the semisubmersible can have the same shape, or a combination of shapes can be used for an individual pontoon.

The semisubmersible can have at least one or a plurality of pontoons 12*a* and 12*b* attached to and extending between pairs of adjacent surface piercing columns. One or more ballast tanks can be in each pontoon.

In an embodiment, the pontoons can have an overall length from 30 meters to 800 meters, a height from 7 meters to 60 meters, and a beam or width of about 10 meters to 800 meters.

The semisubmersible can have a tunnel structure with a tunnel side 202 formed between a pair of surface piercing columns 10*a* and 10*b* on a pontoon 12*a*, and an additional tunnel side 204 formed between a pair of surface piercing columns 10*c* and 10*d* on an additional pontoon 12*b*.

The tunnel structure can contain water at an operational depth when the semisubmersible is ballasted to an operational depth 71. The tunnel structure can be free of water when the semisubmersible is deballasted to a transit depth.

The tunnel structure is either affixed to a portion of the plurality of pontoons, or affixed between the plurality of pontoons.

The tunnel structure has a tunnel opening formed in the tunnel structure. The tunnel opening is configured to allow a floating vessel at the operational depth to enter the tunnel structure and to permit a floating vessel to enter and exit the tunnel structure while the semisubmersible is at sea.

The tunnel structure contains water when the semisubmersible is at the operational depth creating a safe haven for transfer of at least one of: personnel and supplies from a floating vessel to the semisubmersible in the tunnel structure.

FIG. 1A depicts an embodiment of the semisubmersible without a closable door.

The semisubmersible has a tunnel structure formed secured to the surface piercing columns and the pontoons, or formed between the pontoons. The tunnel structure can be a fixed or movable tunnel structure between the pontoons.

The semisubmersible 6 can have a tunnel wall 206 formed between a pair of pontoons 12*a* and 12*b*.

A tunnel opening 31 can be formed between the tunnel sides 202 and 204. The tunnel opening can permit a floating vessel 200 to enter the tunnel structure at an operational depth 71.

The tunnel structure of the semisubmersible can include a gangway 101 installed in the tunnel structure (or outside the tunnel structure) for quick evacuation of the semisubmersible to the floating vessel.

The tunnel structure of the semisubmersible can include a ramp 102 installed in the tunnel structure.

Figure 1B:
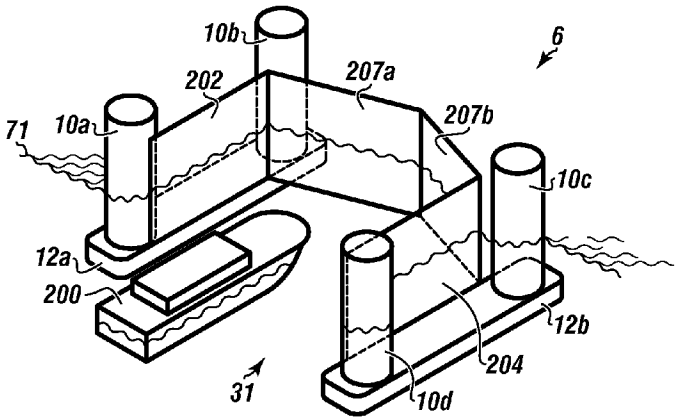
FIG. 1B is persepctive view of another embodiment of the semisubmersible without a door.

FIG. 1B depicts another embodiment of a semisubmersible with the tunnel wall 206 replaced by a pair of closable doors 207*a* and 207*b*.

The semisubmersible 6 can have the pair of closable doors 207*a* and 207*b* formed interior of a plane extending between the outer edges of a pair of pontoons 12*a* and 12*b*.

A tunnel opening 31 can be formed between the tunnel sides allowing water to enter and allowing a floating vessel 200 to enter the tunnel structure at an operational depth.

Figure 1C:
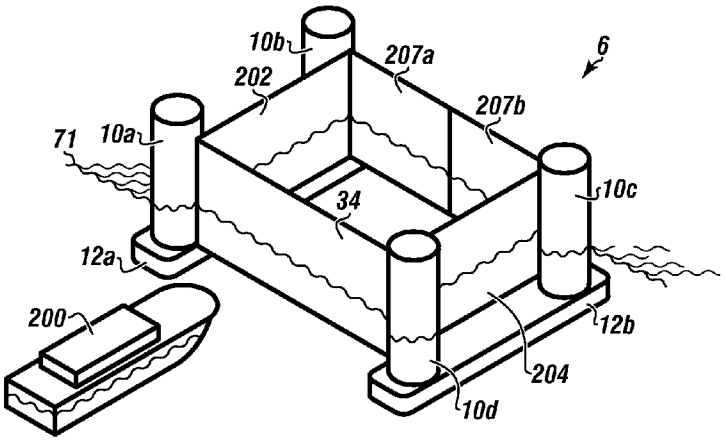
FIG. 1C is a perspective view of an embodiment of the semisubmersible with a closable door.

FIG. 1C depicts an embodiment of the submersible with a closable door 34 over a first tunnel opening and a pair of closable doors over a second tunnel opening.

A first closable door 34 can close a first tunnel opening formed between the tunnel sides. When open, the closable door can permit a floating vessel 200 to enter the tunnel structure at an operational depth 71.

The semisubmersible 6 can have a pair of closable doors 207*a* and 207*b* formed between a pair of pontoons 12*a* and 12*b* over a second tunnel opening allowing a floating vessel 200 to enter and exit the tunnel without turning around.

Figure 1D:
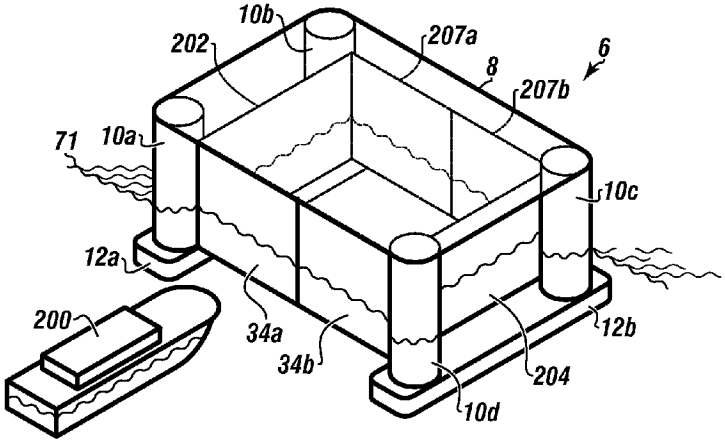
FIG. 1D is a perspective view of an embodiment of a semisubmersible with a pair of closable doors and a main deck over the surface piercing columns.

FIG. 1D depicts an embodiment of a semisubmersible 6 with a first pair of closable doors 34*a* and 34*b* over the first opening and a second pair of closable doors 207*a* and 207*b* over the second opening.

the pair of closable doors can be formed interior of a plane extending between the outer edges of a pair of pontoons 12*a* and 12*b*.

In embodiments, the semisubmersible can have from 2 to pontoons to 16 pontoons.

In embodiments, the semisubmersible can have three surface piercing columns each on a pontoon, forming a triangular semisubmersible.

In embodiments, the semisubmersible can have from 1 surface piercing column to 6 surface piercing columns per pontoon forming a dual pontoon semisubmersible.

In other embodiments, the semisubmersible can have from 1 surface piercing column to 16 surface piercing columns per pontoon forming a multihull semisubmersible.

Figure 2:
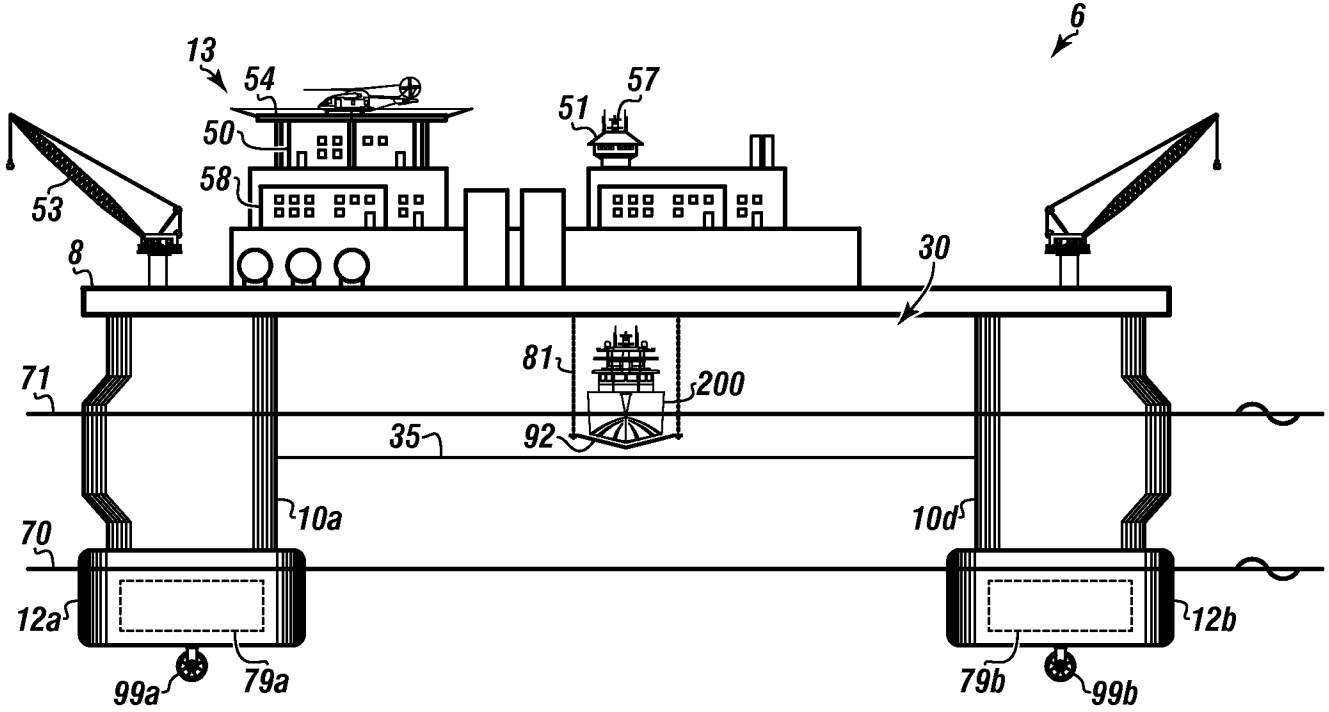
FIG. 2 is a front view of the semisubmersible with floating vessel at an operational depth.

FIG. 2 shows a front view of a semisubmersible 6 with a main deck 8 and a tunnel structure 30 below the main deck.

The main deck 8 can have a shape when viewed from a top view, that is one of the following shapes: rectangle square, round, polygonal, and ellipsoid.

The main deck can be secured to the surface piercing columns above the operational depth of the semisubmersible.

The semisubmersible can have a plurality of pontoons 12*a* and 12*b*, each pontoon can have a thruster 99*a* and 99*b*. The thrusters can generate adequate propulsion to enable the semisubmersible to be self propelled, perform dynamic positioning, or both.

In embodiments, the thrusters can be propellers attached to a keel portion of each pontoon. Each thruster can be operated by a motor, connected to a generator, with the motor and the generator connected to a fuel tank, with the trusters, the motor, and the generator communicating with a navigation system in a control center mounted above the main deck with the control center using the navigation system to dynamically position the semisubmersible over a well for drilling or for propulsion during transit when deballasted.

Surface piercing columns 10*a* and 10*d* can connect to the pontoons 12*a* and 12*b*.

In embodiments, each pontoon can have ballast tanks 79*a* and 79*b*. In embodiments, the ballast tanks can be in at least one of: the pontoons and the surface piercing columns. The ballast tanks can have ballast pumps to direct sea water into and out of the ballast tanks.

The tunnel structure 30 formed between the pontoons 12*a* and 12*b* can have a tunnel floor 35 creating a four sided tunnel structure that receives water to an operational depth of the floating vessel when the semisubmersible is at the operational depth; and allows a floating vessel to enter the tunnel structure while floating, and then support the floating vessel with the tunnel floor lifting the floating vessel out of the water as the semisubmersible moves from an operational depth to a transit depth.

Water can flow into the tunnel structure from a body of water in which the semisubmersible is floating to fill the tunnel structure to the operational depth 71. The operational depth 71 can allow the floating vessel 200 to float into and out of the tunnel structure within the semisubmersible at the operational depth 71.

The tunnel structure can be free of water when the submersible is at a transit depth 70.

The semisubmersible can have a lifting mechanism 81 with a movable cradle 92 within the tunnel structure. The lifting mechanism enables the floating vessel 200 to be lifted at least partially out of the water while the floating vessel is within the tunnel structure. The lifting mechanism can be supported on at least one of: the main deck; the tunnel structure; and a component of the semisubmersible below the main deck and above the tunnel structure.

In embodiments, the main deck 8 can support a superstructure 13.

The superstructure 13 can have crew accommodations 58, a heliport 54, a crane 53, a control tower 51, and an aircraft hangar 50. The control tower 51 can have a dynamic position system 57.

Figure 3:
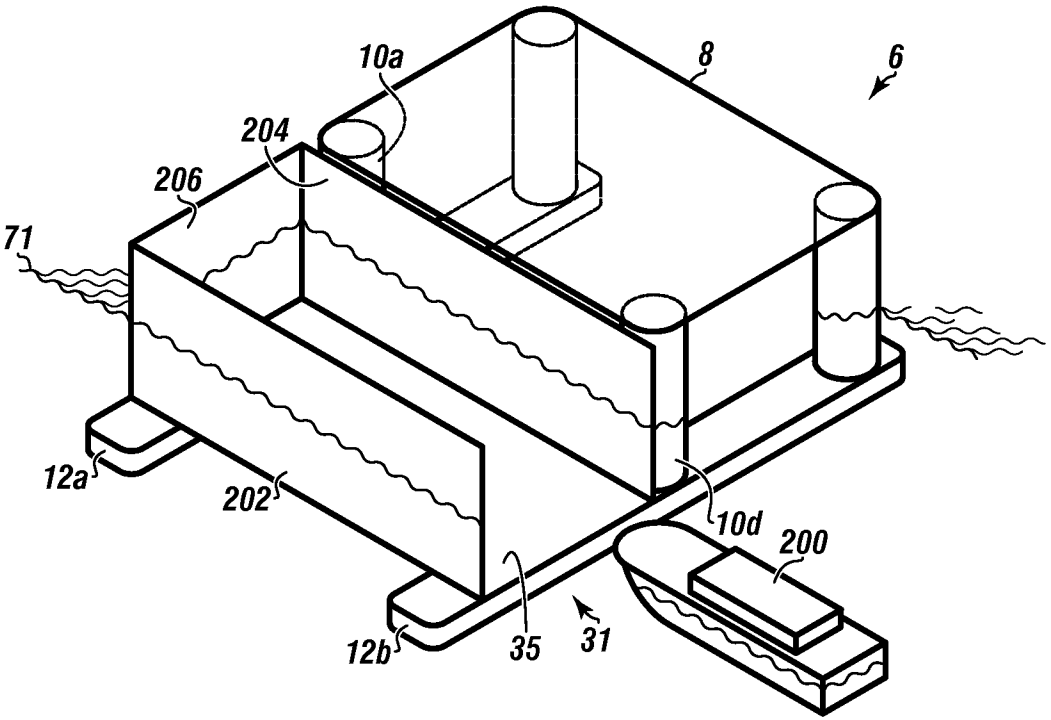
FIG. 3 depicts another embodiment of the semisubmersible with a tunnel structure.

FIG. 3 shows another embodiment of a semisubmersible with a tunnel structure.

The semisubmersible 6 can have a tunnel structure with a tunnel side 202 mounted between the plurality of pontoons 12*a* and 12*b*, and an additional tunnel side 204 mounted between the pontoons 12*a* and 12*b* and attached to two of the surface piercing columns 10*a* and 10*d* forming a tunnel opening 31.

A tunnel wall 206 can connect the tunnel sides 202 and 204. When the semisubmersible ballasts down to an operational depth 71, the floating vessel 200 can flow into the tunnel opening 31 into the tunnel structure above the tunnel floor 35.

A main deck 8 can be mounted over the plurality of surface piercing columns 10*a*-10*d*, but not over the tunnel structure.

In embodiments, the transit depth varies from about 0 meters to about 60 meters, and the operational depth can be from about 3 meters to about 240 meters. The tunnel structure can be out of the water at the transit depth.

Figure 4A:
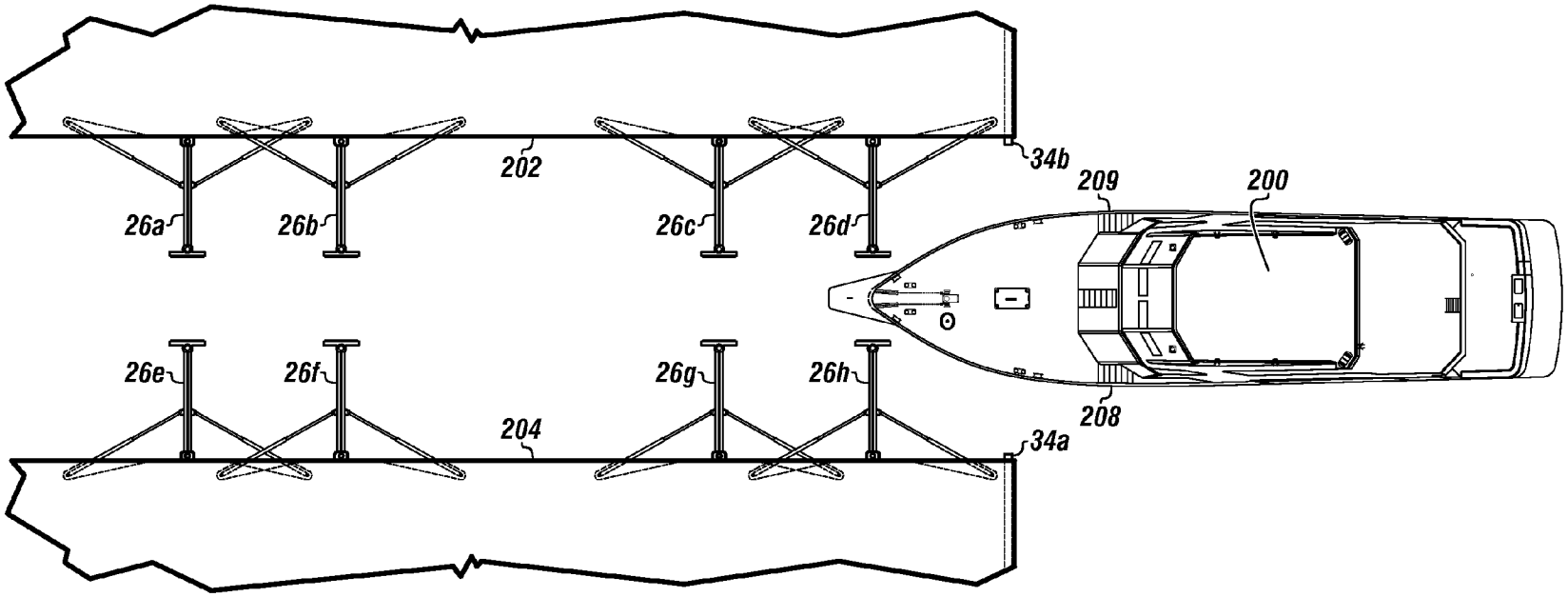
FIG. 4A is a top view of a plurality of dynamic movable saloon doors in a tunnel structure before a floating vessel has contacted the dynamic movable saloon doors.

FIG. 4A shows the floating vessel 200 entering the tunnel structure between tunnel sides 202 and 204 and connecting to a plurality of dynamic movable tendering mechanisms 26*a*-26*h*. Proximate to the tunnel opening are closable doors 34*a* and 34*b* which can be sliding pocket doors to provide either a weather tight or water tight protection of the tunnel structure from the exterior environment. The starboard side 209 hull and port side 208 hull of the floating vessel are also shown.

Figure 4B:
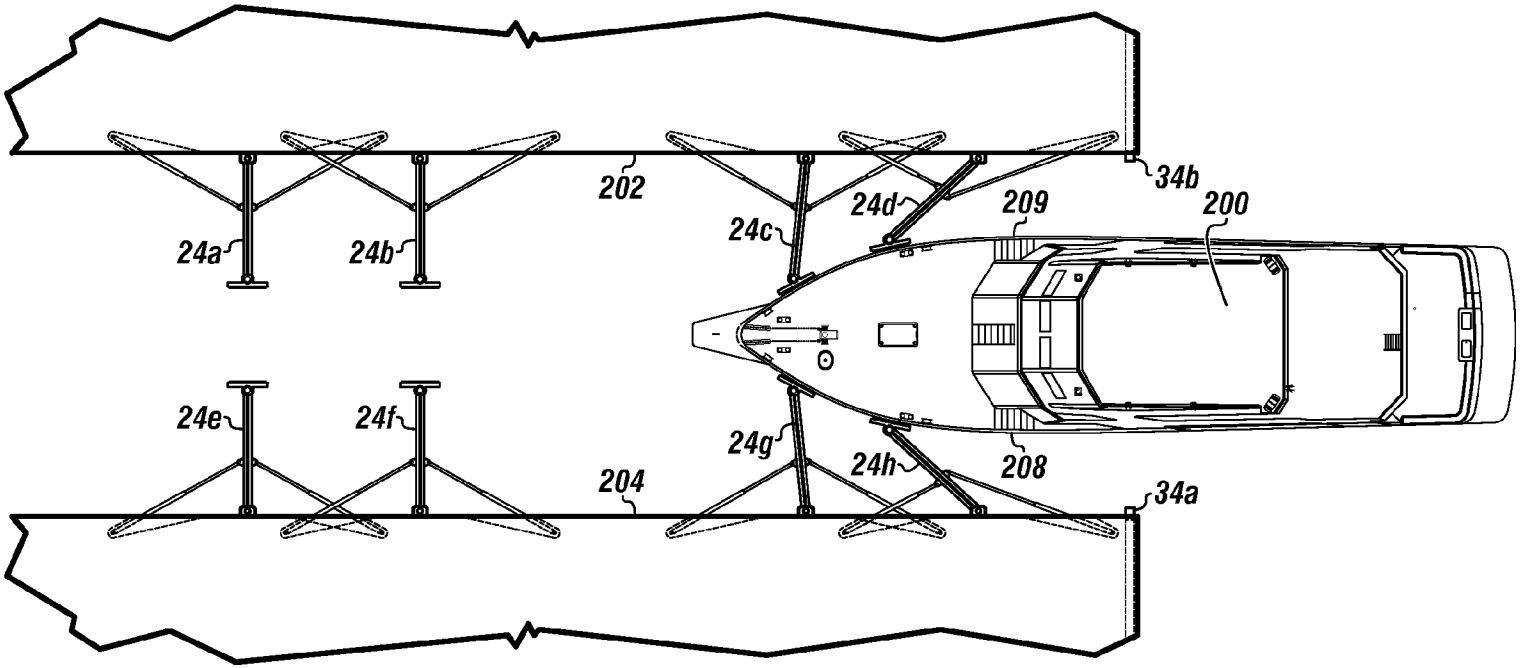
FIG. 4B is a top view of a plurality of dynamic movable saloon doors in a tunnel structure as the hull of a floating vessel has contacted the dynamic movable saloon doors.

FIG. 4B shows the floating vessel 200 inside a portion of the tunnel structure between tunnel sides 202 and 204 and connecting to the plurality of dynamic movable saloon doors 24*a*-24*h*. Dynamic movable saloon doors 24*g* and 24*h* are shown contacting the port sidehull of the floating vessel 200. Dynamic movable saloon doors 24*c* and 24*d* are seen contacting both the starboard side 206 and port side 208 hull or tunnel wall of the floating vessel 200. The closable doors 34*a* and 34*b* are also shown.

Figure 4C:
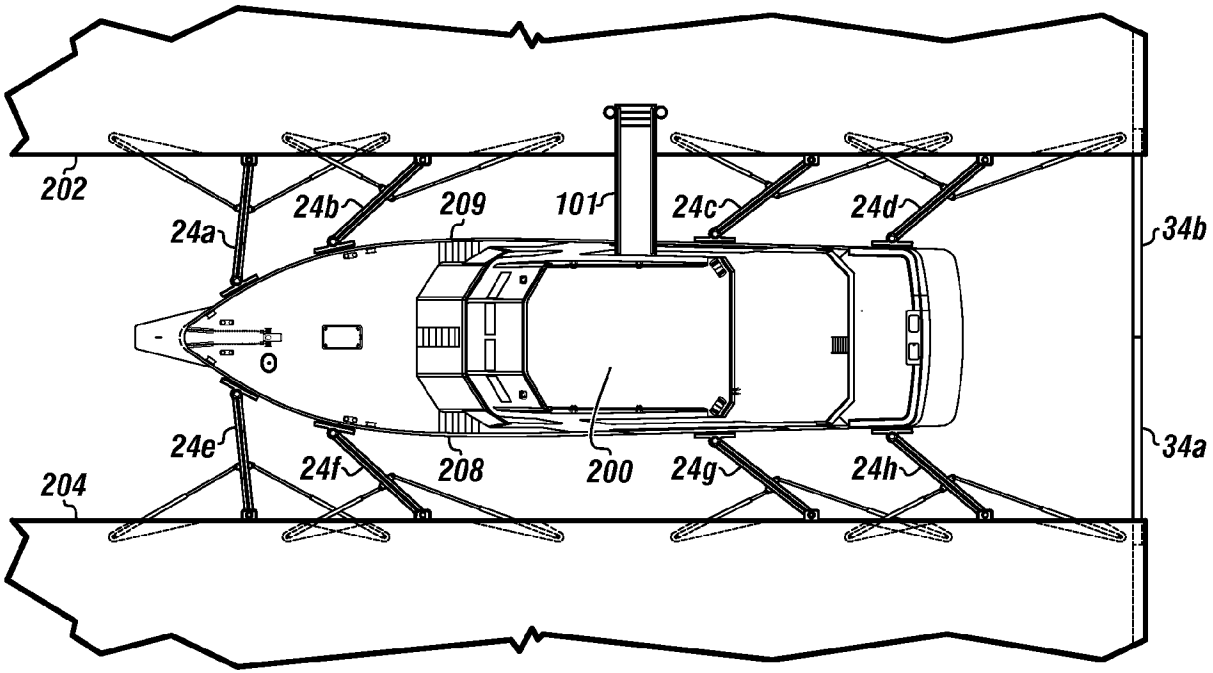
FIG. 4C is a top view of a plurality of dynamic movable saloon doors in a tunnel structure connecting to the floating vessel with one or a plurality of doors closed.

FIG. 4C shows the floating vessel 200 in the tunnel structure between tunnel sides 202 and 204 and connecting to the plurality of dynamic movable saloon doors 24*a*-24*h* and also connected to a gangway 101. Proximate to the tunnel opening are closable doors 34*a* and 34*b* which can be sliding pocket doors oriented in a closed position providing either a weather tight or water tight protection of the tunnel structure from the exterior environment. The plurality of the dynamic movable saloon doors 24*a*-24*h* are shown in contact with the hull of the floating vessel on both the starboard side 209 and port side 208.

Figure 5:
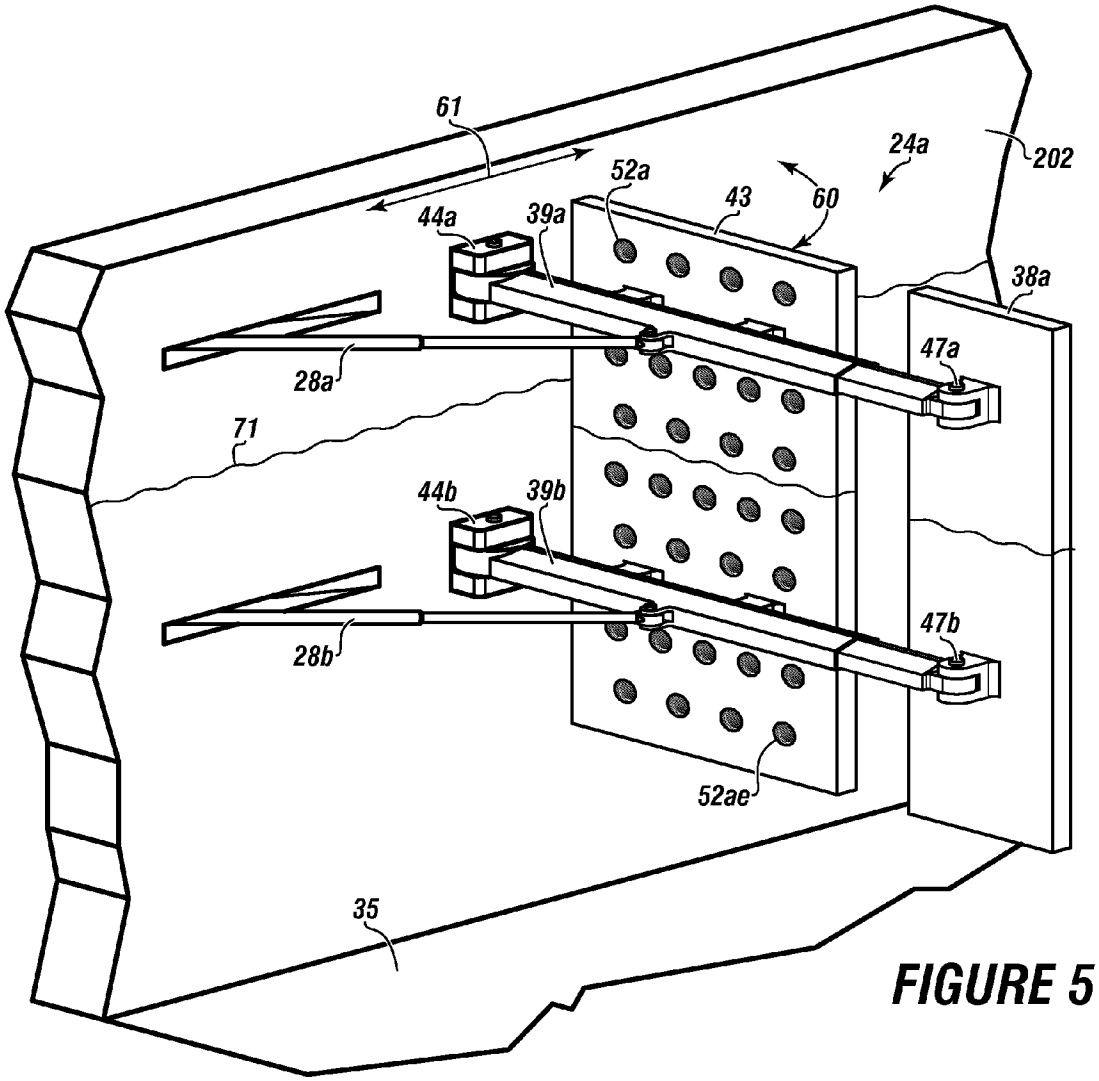
FIG. 5 is an elevated perspective view of one of the dynamic movable saloon doors.

FIG. 5 shows one of the plurality of the dynamic movable saloon doors 24*a*. Each dynamic movable saloon door can have a pair of rotatable arms 39*a* and 39*b* mounted to a tunnel side, shown as tunnel side 202 in this Figure.

Each rotatable arm can sustain a hydraulic force from 5 tons to 150 tons.

A fender 38*a* can connect to each of the pair of rotatable arms 39*a* and 39*b* on the sides of the rotatable arms opposite the tunnel side.

A plate 43 can be mounted to the pair of rotatable arms 39*a* and 39*b* between the fender 38*a* and the tunnel structure.

The plate mounted to the pair of rotatable arms can be positioned to extend below the water surface in the tunnel structure while the tunnel structure and the semisubmersible are at an operational depth. The plate is configured to dampen or break up movement of water in the tunnel structure.

The plate 43 can have a width from 2 meters to 30 meters and a height from 2 meters to 60 meters.

The plate can be made from a frame with intersecting tubulars, the intersecting tubulars providing support to the frame and forming water penetrating openings allowing water to pass through the frame.

The plate can be a solid plate or have perforations, such as open spaces penetrating the plate.

The plate can be configured to swing through 90 degrees of rotation either clockwise or counterclockwise for a total 180 degrees of rotational ability.

The plate 43 can be mounted above the tunnel floor 35 and positioned to extend above the operational depth 71 in the tunnel structure and below the operational depth 71 in the tunnel structure simultaneously.

The plate 43 can be configured to dampen movement of the floating vessel as the floating vessel moves from side to side in the tunnel structure. The plate and entire dynamic movable tendering mechanism can prevent damage to the ship hull, and push a floating vessel away from a ship hull without breaking towards the tunnel center. The embodiments can allow a vessel to bounce in the tunnel structure without damage.

A plurality of pivot anchors 44*a* and 44*b* can connect one of the rotatable arms to the tunnel structure.

Each pivot anchor can enable the plate to swing from a collapsed orientation against the tunnel structure to an extended orientation at an angle 60, which can be up to 90 degrees from a plane 61 of a wall of the tunnel structure enabling the plate on the rotatable arm and the fender to simultaneously (i) shield the tunnel structure from waves and water sloshing effects, (ii) absorb kinetic energy of the floating vessel as the floating vessel moves in the tunnel structure, and (iii) apply a force to push against the floating vessel keeping the floating vessel away from the side of the tunnel structure.

A plurality of fender pivots 47*a* and 47*b* are shown, wherein each pivot can form a connection between each rotatable arm and the fender 38*a*, each fender pivot can allow the fender to pivot from one side of the rotatable arm to an opposite side of the rotatable arm through at least 90 degrees as the floating vessel contacts the fender 38*a*. The fender pivots are shown in the drawing as hinges.

A plurality of openings 52*a*-52*ae* in the plate 43 can reduce wave action. Each opening can have a diameter from 0.1 meters to 2 meters. In embodiments, the openings 52 can be ellipses.

At least one hydraulic cylinder 28*a* and 28*b* can be connected to each rotatable arm for providing resistance to floating vessel pressure on the fender and for extending and retracting the plate from the tunnel sides.

Figure 6:
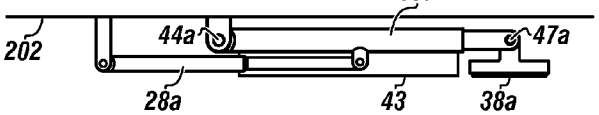
FIG. 6 is a collapsed top view of one of the dynamic movable saloon doors.

FIG. 6 shows one of the pair of rotatable arms 39*a* mounted to a tunnel side 202 in a collapsed position.

The rotatable arm 39*a* can be connected to one of the pivot anchors 44*a* that engages the tunnel side 202.

Fender pivot 47*a* can be mounted on the rotatable arm 39*a* opposite the pivot anchor 44*a*.

The fender 38*a* can be mounted to the fender pivot 47*a*.

The plate 43 can be attached to the rotatable arm 39*a*.

The hydraulic cylinder 28*a* can be attached to the rotatable arm 39*a* and the tunnel wall.

Figure 7:
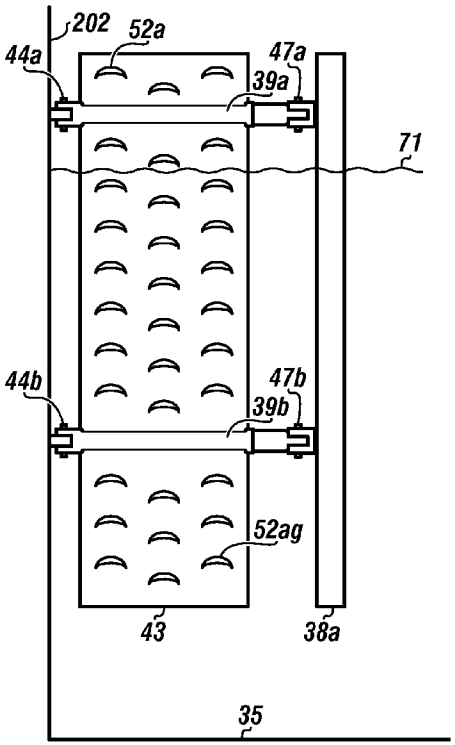
FIG. 7 is a side view of an embodiment of the dynamic movable saloon door.

FIG. 7 shows the plate 43 with a plurality of openings 52*a*-52*ag* that are ellipsoidal in shape, wherein the plate is mounted above the tunnel floor 35.

The plate can extend both above and below the operational depth 71.

The tunnel side 202, the plurality of pivot anchors 44*a* and 44*b*, the pair of rotatable arms 39*a* and 39*b*, the plurality of fender pivots 47*a* and 47*b*, and fender 38*a* are also shown.

Figure 8:
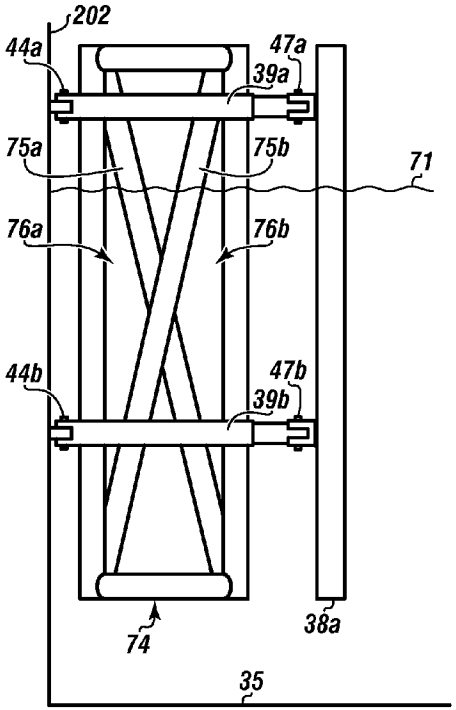
FIG. 8 is a side view of another embodiment of the dynamic movable saloon door.

FIG. 8 shows an embodiment of a dynamic movable saloon door formed from a frame 74 instead of the plate. The frame 74 can have intersecting tubulars 75*a* and 75*b* that form openings 76*a* and 76*b* for allowing water to pass while water in the tunnel structure is at an operational depth 71.

The tunnel side 202, the tunnel floor 35, the plurality of pivot anchors 44*a* and 44*b*, the pair of rotatable arms 39*a* and 39*b*, the plurality of fender pivots 47*a* and 47*b*, and fender 38*a* are also shown.

Figure 9:
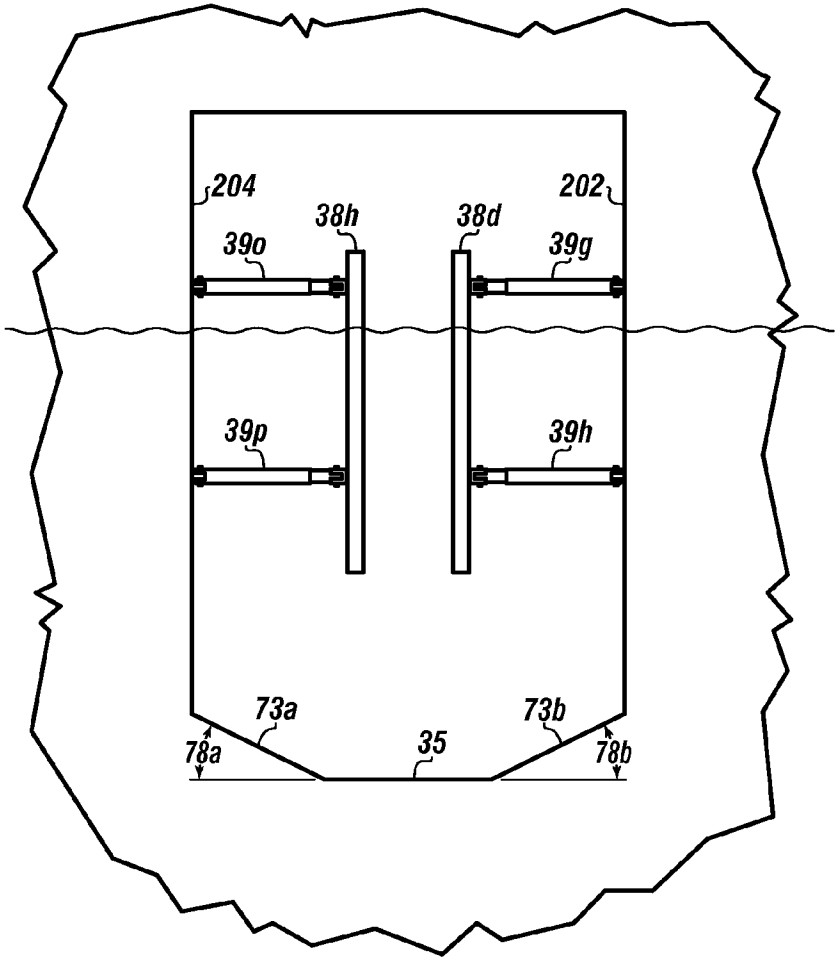
FIG. 9 is a cut away view of the tunnel structure.

FIG. 9 shows the tunnel floor 35 having lower tapering surfaces 73*a* and 73*b* at an entrance of the tunnel structure, providing a "beach effect" that absorbs surface wave energy effect inside of the tunnel structure. The lower tapering surfaces can be at an angle 78*a* and 78*b* that is from 3 degrees to 60 degrees.

Two fenders 38*h* and 38*d* can be mounted between two pairs of rotatable arms. Fender 38*h* can be mounted between the pair of rotatable arms 390 and 39*p*, and fender 38*d* can be mounted between rotatable arms 39*g* and 39*h*.

In embodiments, the pair of rotatable arms can be extendable and retractable. As shown in the figure, rotatable arms 39*g*, 39*h*, 39*o*, and 39*p* can be constructed in a telescoping manner, allowing them to extend and retract.

The tunnel walls 202 and 204 are also shown.

Figure 10:
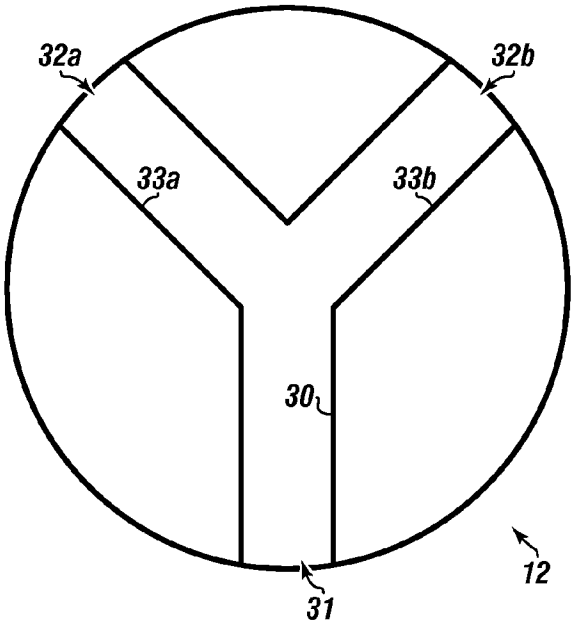
FIG. 10 is a top view of a Y-shaped tunnel structure in the hull of the semisubmersible.

FIG. 10 shows a Y-shaped configuration from a top cutaway view of the hull 12 with the tunnel structure 30 with the tunnel opening 31, in communication with a branch 33*a* and branch 33*b* going to additional tunnel openings 32*a* and 32*b* in the tunnel structure to a location exterior of the semisubmersible, respectively.

The semisubmersible can have a tunnel structure which includes a plurality of branches, wherein each branch has a tunnel opening communicating to a location exterior of the semisubmersible.

The semisubmersible can have a transit depth and an operational depth, wherein the operational depth is achieved using ballast pumps and filling ballast tanks in the hull with water after moving the structure at transit depth to an operational location.

The transit depth can be from about 0 meters to about 60 meters, and the operational depth can be from about 3 meters to about 240 meters. The tunnel structure can be out of water during transit.

Straight, curved, or tapering sections in the hull can form the tunnel structure.

In embodiments, the plate, closable doors, and pontoons can be made from steel.

While these embodiments have been described with emphasis on the embodiments, it should be understood that within the scope of the appended claims, the embodiments might be practiced other than as specifically described herein.

What is claimed is:

1. A semisubmersible capable of ballasting and deballasting between a transit depth and an operational depth comprising:

a. a plurality of surface piercing columns;

b. a plurality of pontoons attached to and extending between pairs of adjacent surface piercing columns;

c. a tunnel structure either affixed to a portion of the plurality of pontoons, affixed between the plurality of pontoons, or affixed to the surface piercing columns, the tunnel structure comprising: a tunnel opening formed in the tunnel structure, the tunnel opening configured to allow a floating vessel at the operational depth to at least enter the tunnel structure and to permit the floating vessel to enter and exit the tunnel structure while the semisubmersible is at sea;

d. a main deck secured to the plurality of surface piercing columns above the operational depth; and e. a plurality of dynamic movable saloon doors connected to opposing sides of the tunnel structure, the dynamic movable saloon doors connect for contacting with at least one side of the floating vessel, enabling the tunnel structure to safely receive the floating vessel securely for loading and unloading while the semisubmersible is at the operational depth, wherein at least one of the plurality of dynamic movable saloon doors comprises:

(i) a pair of rotatable arms mounted on opposite sides of the tunnel structure;

(ii) a fender connected to each of the pair of rotatable arms on a side of the rotatable arm opposite the tunnel side;

(iii) a plate mounted to the pair of rotatable arms, the fender and the tunnel structure, the plate is positioned to extend below the water surface in the tunnel structure while the tunnel structure and the semisubmersible are at the operational depth, further wherein the plate is configured to dampen or break up movement of water in the tunnel structure; and (iv) a plurality of pivot anchors, each pivot anchor connecting one of the pair of rotatable arms to the tunnel structure, wherein each pivot anchor enables the plate to swing from a collapsed orientation against the tunnel structure to an extended orientation at an angle that is up to 90 degrees from a plane of a tunnel wall of the tunnel structure enabling the plate on the pair of rotatable arms and the fender to simultaneously: (i) shield the tunnel structure from water sloshing effects, (ii) absorb kinetic energy of the floating vessel as the floating vessel moves in the tunnel structure, and (ii) apply a force to push against the floating vessel keeping the floating vessel away from the tunnel side of the tunnel structure; and wherein the tunnel structure contains water when the semisubmersible is at the operational depth creating a safe haven for transfer of at least one of: personnel and supplies from the floating vessel to the semisubmersible in the tunnel structure.

2. The semisubmersible of claim 1, comprising a tunnel floor formed in the tunnel structure creating a four sided safe haven tunnel structure that receives water to the operational depth of the floating vessel when the semisubmersible is at the operational depth, allows the floating vessel to enter the tunnel structure while floating, and then supports the floating vessel with the tunnel floor lifting or pushing the floating vessel out of the water as the semisubmersible moves from the operational depth to the transit depth.

3. The semisubmersible of claim 1, comprising at least one closable door disposed in the tunnel structure to provide for selective isolation of the tunnel structure from locations exterior of the semisubmersible as the semisubmersible floats at the operational depth.

4. The semisubmersible of claim 1, wherein the plate is positioned to extend above the operational depth in the tunnel structure and extend below the operational depth in the tunnel structure simultaneously, and wherein the plate is configured to dampen movement of the floating vessel as the floating vessel moves from side to side in the tunnel structure.

5. The semisubmersible of claim 1, comprising at least one hydraulic cylinder connected to each rotatable arm for providing resistance to the floating vessel contacting the fender and for extending and retracting the plate from the tunnel structure.

6. The semisubmersible of claim 1, comprising a plurality of fender pivots, each fender pivot forming a connection between each rotatable arm and the fender, each fender pivot allowing the fender to pivot from one side of the pair of rotatable arms to an opposite side of the pair of rotatable arms through at least 90 degrees as the floating vessel contacts the fender.

7. The semisubmersible of claim 1, comprising a plurality of openings in the plate to reduce wave action.

8. The semisubmersible of claim 1, wherein the plate comprises: a frame with intersecting tubular members, the intersecting tubular members providing support to the frame and forming water penetrating openings allowing water to pass through the frame.

9. The semisubmersible of claim 1, wherein the tunnel structure comprises at least one additional tunnel opening in the tunnel structure opening to a location exterior of the semisubmersible.

10. The semisubmersible of claim 1, wherein the tunnel structure includes a plurality of branches, wherein each branch has a tunnel opening communicating to a location exterior of the semisubmersible.

11. The semisubmersible of claim 1, wherein the main deck has a superstructure comprising at least one of: crew accommodations, a heliport, a crane, a control tower, and an aircraft hangar.

12. The semisubmersible of claim 1, comprising a thruster mounted to at least one of the plurality of pontoons and a dynamic position system in a control tower enabling the semisubmersible to be at least one of: self-propelled and dynamic positioning enabled.

13. The semisubmersible of claim 1, wherein the pair of rotatable arms are extendable and retractable.

14. The semisubmersible of claim 1, wherein the plurality of surface piercing columns are at least one of: a stepped shape, and a flared shape.

15. The semisubmersible of claim 1, wherein the plurality of surface piercing columns have a shape which is at least one of: a square shape, a rectangular shape, a cylindrical shape, a polygonal shape, and a generally conical shape.

16. The semisubmersible of claim 1, wherein the main deck is a square shape, a round shape, a polygonal shape, and an ellipsoid shape.

17. The semisubmersible of claim 1, further comprising at least one propeller attached to a keel portion of each of the plurality of pontoons, each propeller operated by a motor, connected to a generator, with the motor and the generator connected to a fuel tank, with the propellers, the motor, and the generator communicating with a navigation system in a control center mounted above the main deck with the control center using the navigation system to dynamically position the semisubmersible over a well for drilling or for propulsion during transit when deballasted.

18. The semisubmersible of claim 1, comprising ballast tanks in at least one of: the plurality of pontoons and the plurality of surface piercing columns, with ballast pumps to direct sea water into and out of the ballast tanks.

19. The semisubmersible of claim 1, comprising a lifting mechanism with a movable cradle within the tunnel structure, enabling the floating vessel to be lifted or pushed at least partially out of the water while the floating vessel is within the tunnel structure, the lifting mechanism supported on at least one of:

a. the main deck;
b. the tunnel structure; and
c. a component of the semisubmersible below the main deck and above the tunnel structure.

20. The semisubmersible of claim 1, wherein the tunnel structure comprises at least one closable door over a first opening.

21. The semisubmersible of claim 1, comprising a gangway installed in the tunnel structure for evacuation of the semisubmersible to the floating vessel.

22. The semisubmersible of claim 1, comprising a ramp installed in the tunnel structure.

* * * * *